US006068418A

United States Patent [19]

Fox

[11] Patent Number: 6,068,418

[45] Date of Patent: May 30, 2000

[54] MEDIA GUIDING APPARATUS FOR A PRINTER

[75] Inventor: Duane M. Fox, Snohomish, Wash.

[73] Assignee: Intermec Corporation, Everett, Wash.

[21] Appl. No.: 09/325,922

[22] Filed: Jun. 4, 1999

Related U.S. Application Data

[62] Division of application No. 08/845,781, Apr. 25, 1997, Pat. No. 5,927,876.

[51] Int. Cl.[7] ..... B41J 11/42

[52] U.S. Cl. ..... 400/579; 400/613.1; 101/288

[58] Field of Search ..... 101/219, 228, 101/288; 400/579, 630, 631, 633, 633.1, 613, 613.1; 226/3, 15, 16, 18, 19, 20, 23

[56] References Cited

U.S. PATENT DOCUMENTS 5,009,739 4/1991 Goodwin et al. ..... 156/384

5,092,688 3/1992 Haennelt et al. ..... 400/613

5,988,905 11/1999 Abe et al. ..... 400/613

*Primary Examiner*—Ren Yan

*Attorney, Agent, or Firm*—Joan H. Pauly

[57] ABSTRACT

A printer has a print station and a guide path extending from a media roll station to the print station. Guide apparatus includes an inner edge guide extending along and defining an inner side edge portion of the path. In one embodiment, lateral tracking of the media through the print station is provided by a retractable outer edge guide. The outer edge guide automatically retracts when media is moved into the path through the outer side thereof. The outer edge guide is adjustable to firmly grip the opposite edges of the media between the inner and outer edge guides. In another embodiment, there is no outer edge guide. Instead, one or more tracking wheels are urged against a face of media moving along the path. The wheels are canted in order to provide a laterally inward force on the media. The laterally inward force automatically urges the media against the inner edge guide in both directions of media motion.

11 Claims, 13 Drawing Sheets

FIG. 16B
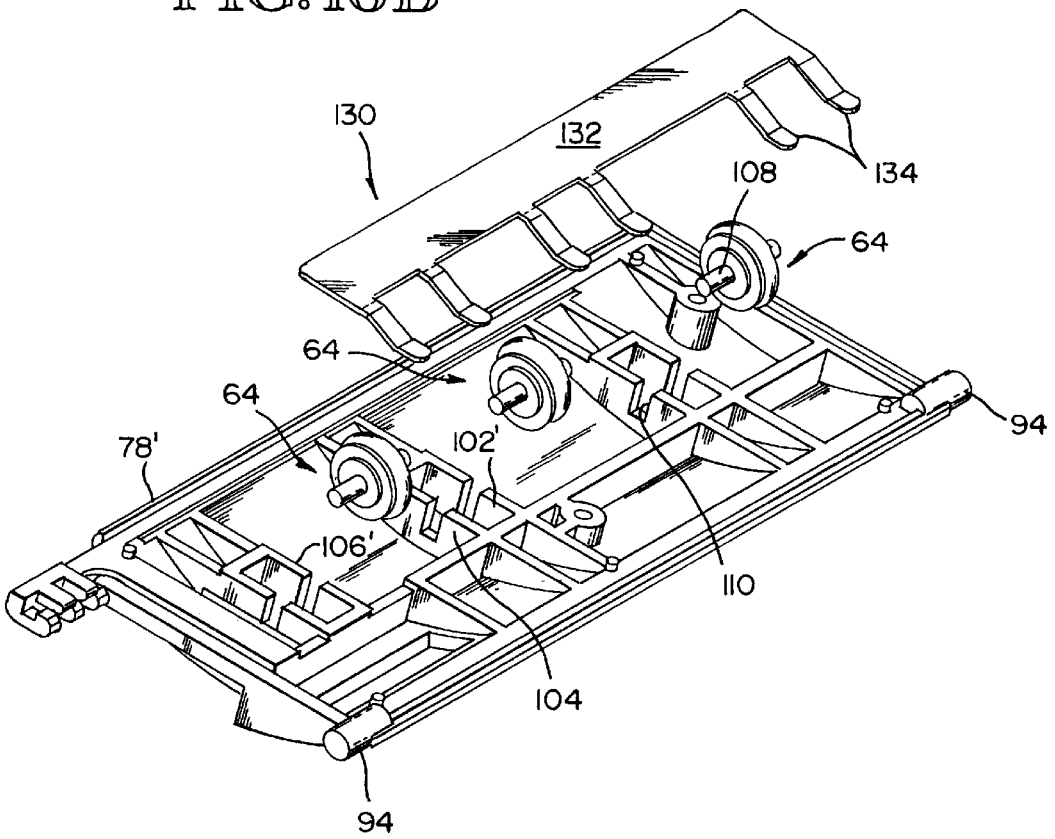
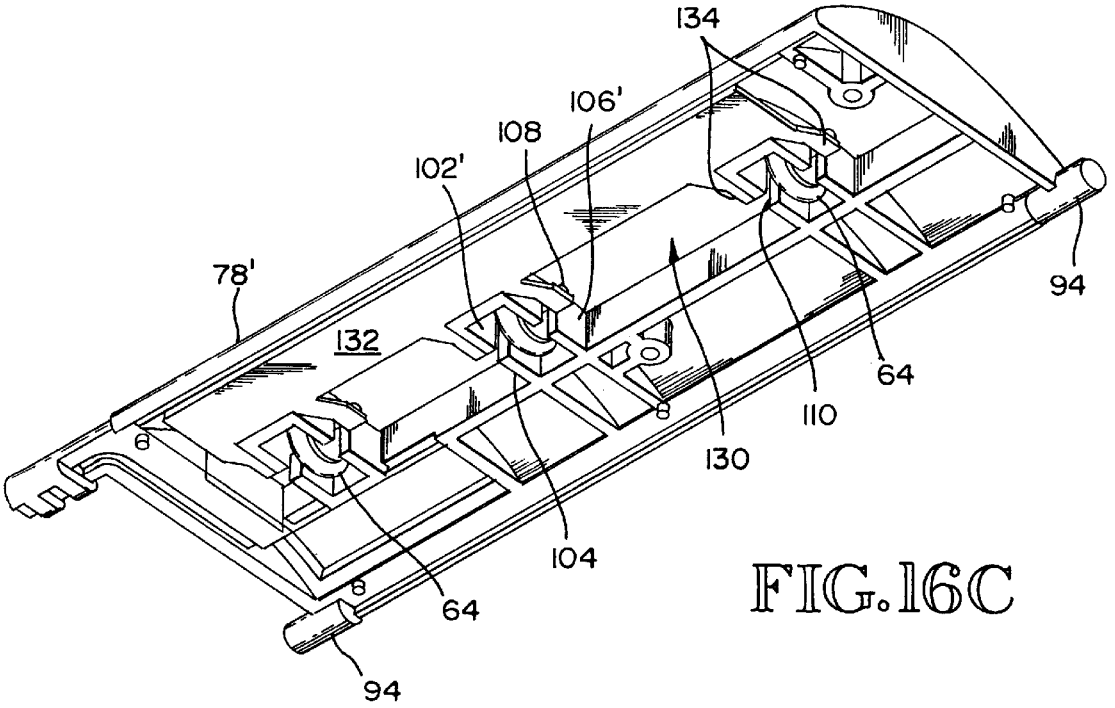
FIG. 16C

MEDIA GUIDING APPARATUS FOR A PRINTER

RELATED APPLICATION

This application is a division of Ser. No. 08/845,781, filed Apr. 25, 1997, now U.S. Pat. No. 5,927,876.

TECHNICAL FIELD

This invention relates to media guiding apparatus for printers and, more particularly, to such apparatus that permits side loading of media into a guide path of a printer through an outer side thereof opposite an inner edge guide without requiring manual retraction of an edge guide, and that provides proper lateral tracking of the media through a print station.

BACKGROUND INFORMATION

Printers that are designed for printing on a continuous strip of media from a media roll generally feed the media from the roll to a print station along a guide path. In order to accomplish proper positioning of the printed matter on the media at the print station, proper lateral tracking of the media as it moves along the guide path is desirable. Conventionally, lateral tracking has been accomplished by using inner and outer edge guides that are positioned to abut the opposite edges of the media and hold the media laterally in position as it moves along the path between the edge guides. In known printers, both of the edge guides may be fixed, or one or both of the edge guides may be movable. In the former case, loading of the media in the printer requires that the media be threaded through the guide path from the media roll to the print station. This can be a time consuming and tedious procedure. To avoid the necessity for threading the media, the outer edge guide may be mounted to be movable from its use position adjacent to a side edge of the guide path to an open position in which it is clear of the side of the guide path. This permits an operator to load the media into the printer by moving the outer edge guide into its open position and then sliding the media into the guide path through the open outer side of the guide path. Once the media has been moved into the guide path, the outer edge guide may be moved back into its use position preparatory to the printing of the media.

It is generally desirable for a printer to be sufficiently versatile to print on media having a variety of widths. In printers having an inner edge guide and an outer edge guide, whether or not the outer edge guide is removable, one or both of the edge guides needs to be adjustable in order to accommodate varying media widths. If the outer edge guide is adjustable but is not movable into an open position, it sometimes must be repositioned and then readjusted each time a new media roll is installed.

An example of a type of printer designed for continuous media is a thermal label printer that prints information, such as bar codes, on labels removably secured to a continuous carrier strip by pressure sensitive adhesive. Bar code labels vary in size and are often required to be quite small. For small labels, it is desirable to have tight registration of the bar code information on the label, with the printed matter extending very close to the edges of the label. This arrangement requires very accurate lateral tracking of the blank labels as they are moved toward the print station.

SUMMARY OF THE INVENTION

The present invention relates to printers of a type having a print station and a guide path extending from a media roll station to the print station. The major goals of the intention are to provide proper lateral tracking of the media through the print station and to make the loading operation of media into the guide path easier and more efficient.

According to an aspect of the invention, guide apparatus comprises an inner edge guide extending along and defining an inner side edge portion of the guide path. The apparatus also includes means for allowing side loading of media into the guide path through an outer side thereof opposite the inner side edge portion without requiring manual retraction of a structural element defining a side portion of the guide path, and for providing proper lateral tracking of the media through the print station.

In one embodiment of the invention, the means for allowing side loading and for providing lateral tracking comprises a retractable outer edge guide biased into a position extending along and defining an outer side edge portion of the path opposite the inner side edge portion. The outer edge guide is automatically retractable in response to media being passed thereover and moved into the guide path through the outer side.

According to another aspect of the invention, guide apparatus comprises an inner edge guide extending along and defining an inner side edge portion of the path, and a retractable outer edge guide positioned on an outer side of the path. The outer edge guide is biased into a position extending along and defining an outer side edge portion of the path opposite the inner side edge portion. The outer edge guide is automatically retractable in response to media being passed thereover and moved into the guide path through the outer side.

A preferred feature of the outer edge guide is that it be movable toward and away from the inner edge guide. This permits adjustment of the width of the guide path to accommodate media having different widths. Another preferred feature is a ramp surface on the outer edge guide positioned to be contacted by media moving into the guide path through the outer side thereof.

In the preferred form of embodiments of the guide apparatus having a retractable outer edge guide, the apparatus comprises a guide plate extending along the guide path. The outer edge guide is slidably mounted on the guide plate to permit an operator to slide the outer edge guide toward and away from the inner edge guide and thereby adjust the guide path width. Preferably, the apparatus comprises an elongated outer edge guide housing slidably mounted on the guide plate and having opposite ends. The outer edge guide comprises a retractable ramp section at each of the opposite ends. Each ramp section has a ramp surface positioned to be contacted by media moving into the guide path through the outer side of the path.

In the first preferred embodiment, a slide plate is secured to a surface of the guide plate opposite the guide path. The slide plate has an elongated laterally extending adjustment slot extending therethrough. The guide plate has a pair of spaced apart laterally extending slots extending therethrough. The ramp sections project through the pair of slots. The guide apparatus also includes an adjustment bolt projecting through the adjustment slot and an opening in the outer edge guide housing. An adjustment knob engages the bolt to releasably secure the housing relative to the slide plate and the ramp sections in a lateral position relative to the inner edge guide.

Printers constructed in accordance with the invention greatly simplify the procedure for loading media into the guide path and facilitate adjustment of the guide apparatus to accommodate varying media widths. To load media, there is no need for an operator to either thread the media along the path between inboard and outboard edge guides or reposition an edge guide to gain access to the path. For loading media that is of the same width as previously used media, all that is required to load the media is for the operator to slide a strip of the media through the outer side of the path and over the outer edge guide. The outer edge guide automatically retracts in response to the media being moved into the guide path. Once adjusted for a given media width, the outer edge guide does not need to be adjusted, repositioned, or manually retracted each time a new media roll is installed. Thus, the loading procedure is a simple, one-step procedure that an operator can normally accomplish using only one hand. If it is desired to have the capacity to print on media of varying widths, the preferred feature of lateral adjustability of the outer edge guide may be provided. In such case, when changing media widths, the loading procedure has the additional step of adjusting the outer edge guide before and/or after the media is slid into the guide path.

These and other advantages and features will become apparent from the detailed description of the best modes for carrying out the invention that follows.

BRIEF DESCRIPTION OF THE DRAWINGS

In the drawings, like element designations refer to like parts throughout, and:

FIG. 16B is an exploded pictorial view looking down at a modified form of the tracking wheel assembly, with the cover plate removed.

FIG. 16C is a pictorial view looking up at the assembly components shown in FIG. 16B in an assembled condition.

BEST MODES FOR CARRYING OUT THE INVENTION

Figure 1:
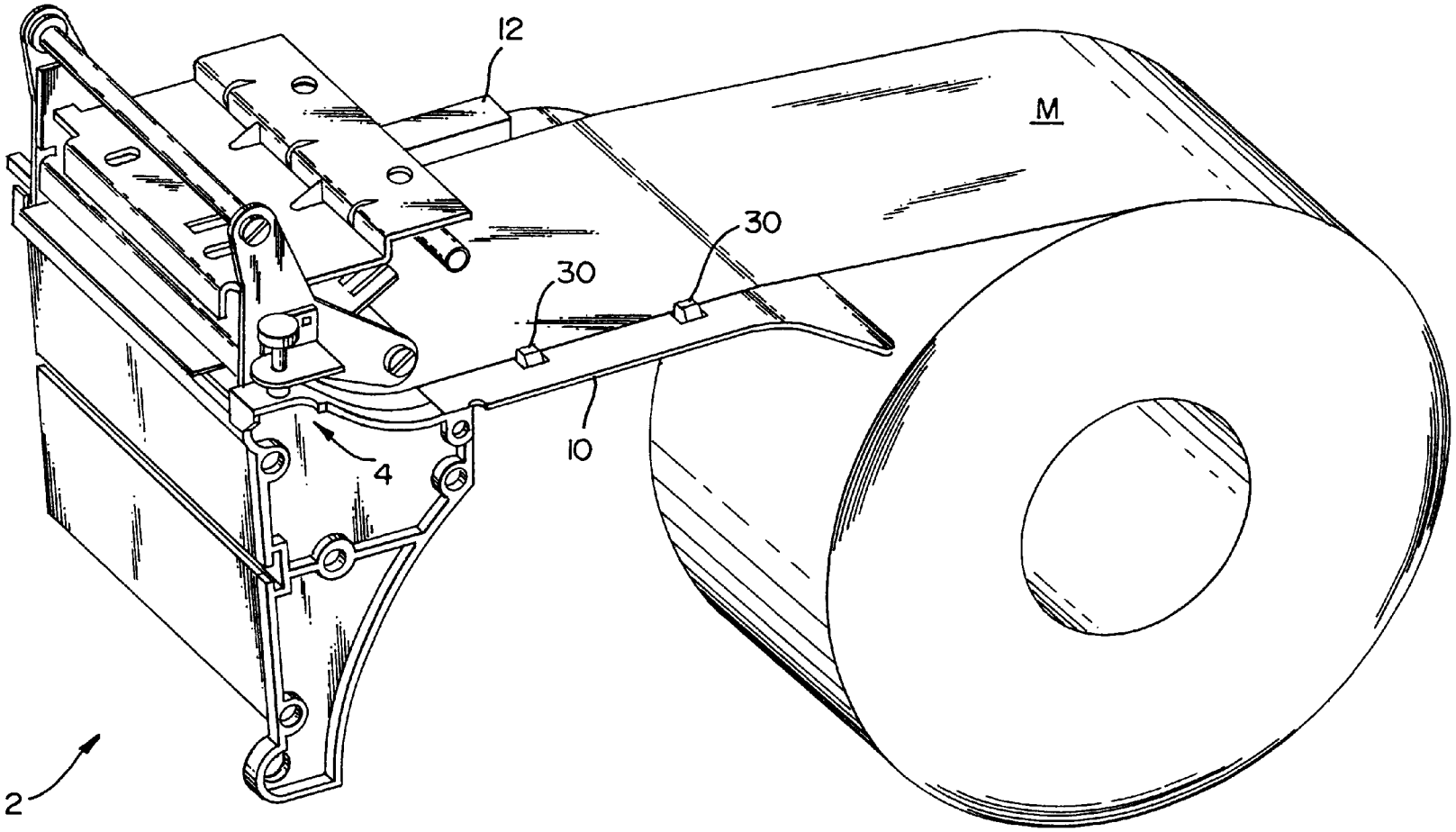
FIG. 1 is a pictorial view of the first preferred embodiment of the invention and related printer structure, with the upper guide plate omitted to facilitate illustration of the invention.

The drawings show two types of guide apparatus that are constructed according to the invention and that also constitute the best modes for carrying out the invention currently known to the applicant. FIGS. 1–7 show a first preferred embodiment of the invention. FIGS. 8–17 show a second preferred embodiment. In each of the illustrated embodiments, the guide apparatus is incorporated into a printer 2, 2' designed for printing on media M fed along a guide path P from a media roll station to a print station 4. A print head 6 at the print station 4 prints bar code information or other matter onto the upper surface of the media M as it passes through the print station 4. Between the media roll station and the print station 4, the guide path P is vertically defined between an upper guide plate 8, 8' and a lower guide plate 10, 10'. It is contemplated that the guide apparatus of the invention will be used primarily in the type of printer 2, 2' illustrated and described herein. However, it is intended to be understood that the guide apparatus of the invention may also be used to advantage in other types of printers.

Referring to FIGS. 1–4, in the first preferred embodiment of the guide apparatus, the upper guide plate 8 has an upstream end that curves upwardly adjacent to the media roll station. The plate 8 extends downstream from its curved upstream end along a straight main portion of the guide path P. The plate 8 terminates in a downstream end spaced from the print station 4. There is a small discontinuity in the plate 8 downstream of the midportion thereof. The lower guide plate 10 has an upstream end that slopes downwardly toward the media roll station. The plate 10 extends from the upstream end along the straight portion of the path P parallel to the upper guide plate 8 and then slopes upwardly to the print station 4. The configurations of the two guide plates 8, 10 may be varied, but they preferably have diverging upstream ends to accommodate varying angles of the media being fed into the guide path P from the media roll. They also preferably have straight midportions to stabilize movement of the media from the media roll station to the print station 4.

Still referring to FIGS. 1–4, the guide assembly includes a fixed inner edge guide 12 extending along and defining an inner side edge portion of the path P. The inner edge guide 12 extends horizontally along the inner edges of the straight main portions of the guide plates 8, 10 and vertically across the path P defined therebetween. Preferably, the edge guide 12 is secured at least to the upper guide plate 8. The apparatus also includes an outer edge guide positioned along the path P opposite the inner edge guide 12. In operation of the printer 2, a media strip M from a media roll is fed between the inner edge guide 12 and the outer edge guide from the media roll station to the print station 4. The inner and outer edge guides are preferably positioned tightly against the opposite edges of the media M to prevent lateral wandering of the media M as it moves along the path P and thereby provide proper lateral tracking of the media M through the print station 4.

Figure 4:
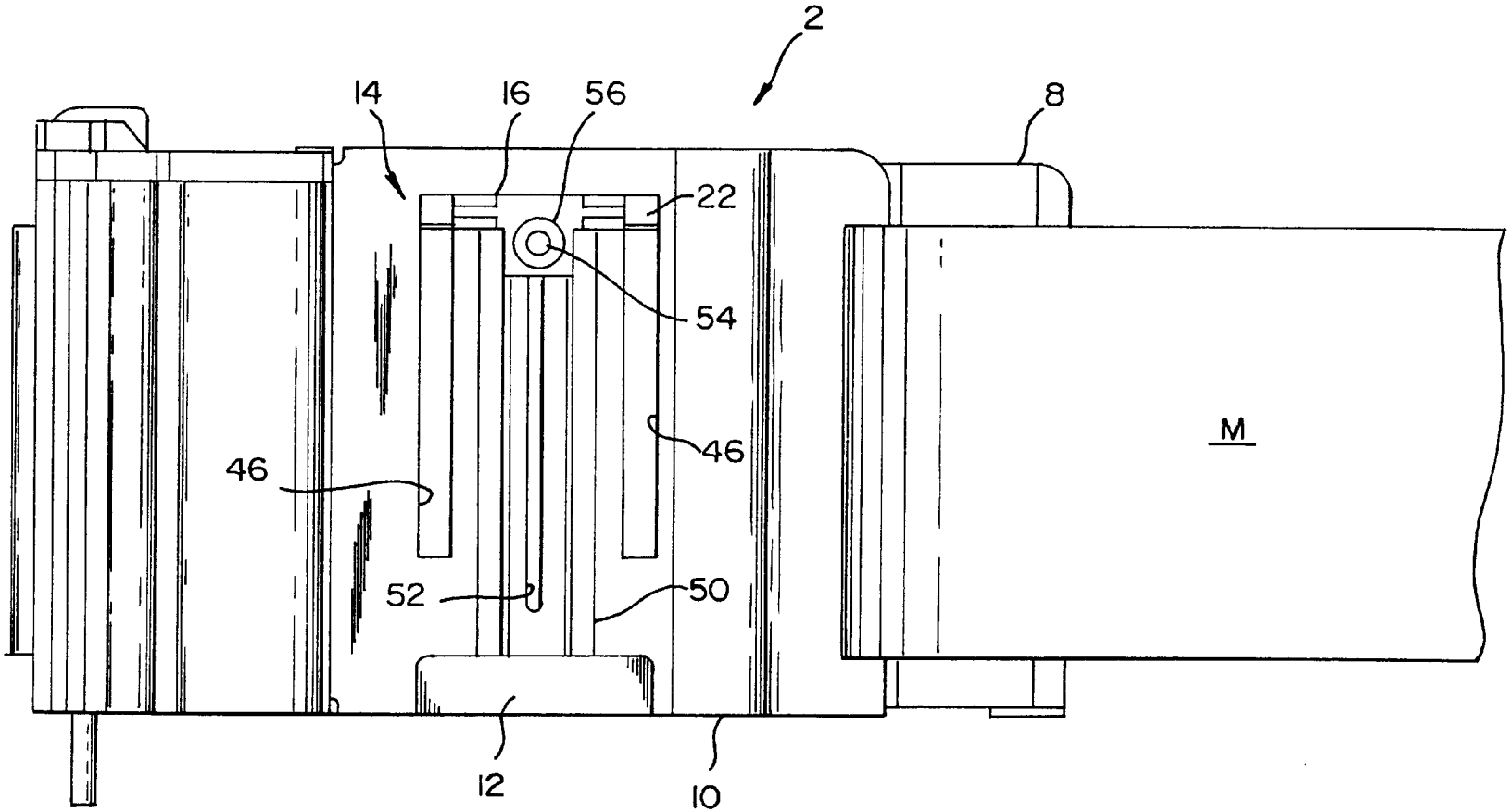
FIG. 4 is a bottom plan view of the apparatus shown in FIG. 2.
Figure 5:
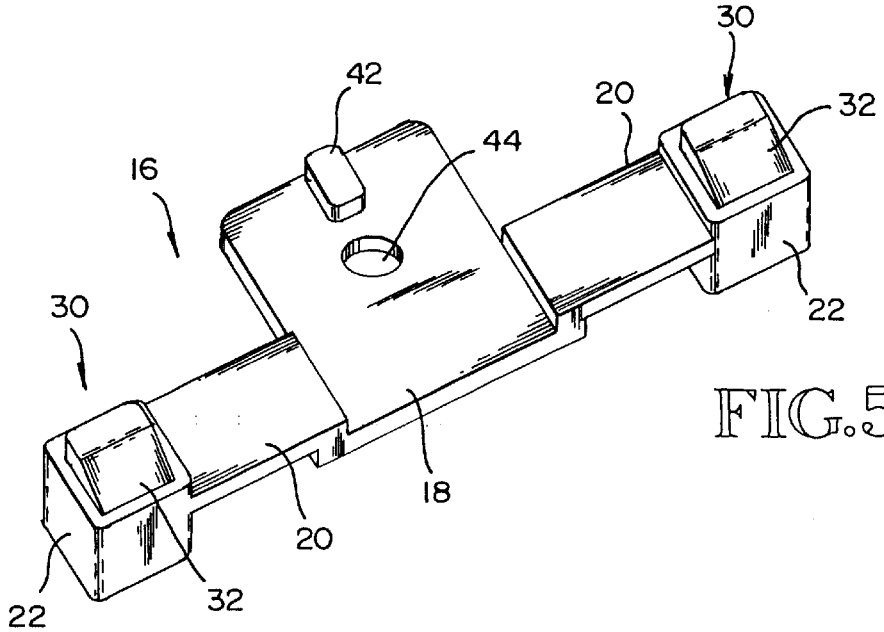
FIG. 5 is a pictorial view of the outer edge guide and guide housing shown in FIGS. 1–4.
Figure 6:
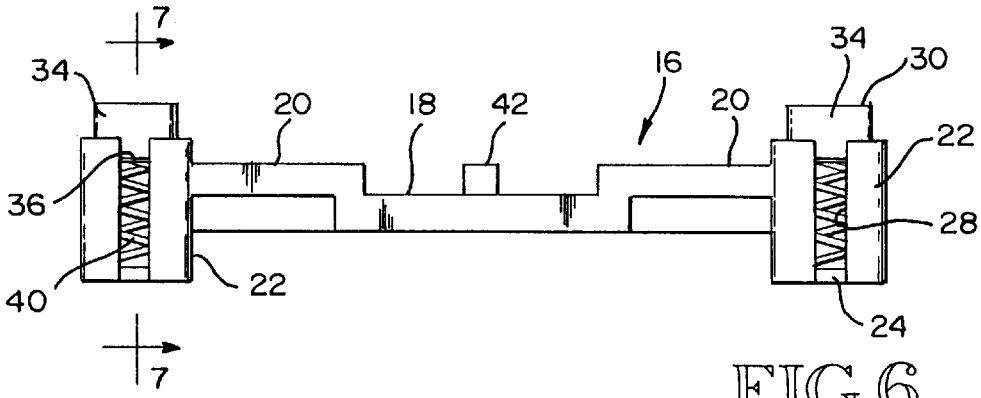
FIG. 6 is a side elevational view of the outer edge guide and housing shown in FIG. 5.
Figure 7:
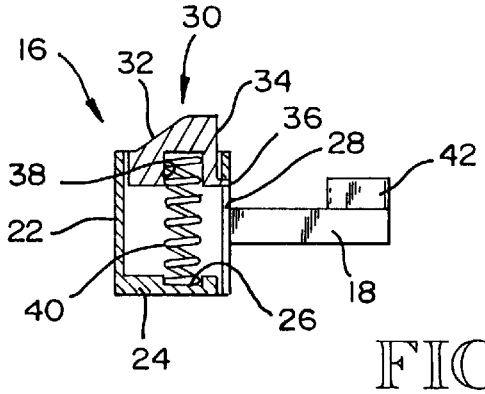
FIG. 7 is a sectional view taken along the line 7—7 of FIG. 6.

Referring to FIGS. 2–7 and particularly FIGS. 5–7, the outer edge guide assembly 14 includes an elongated outer edge guide housing 16 having a center portion 18 and opposite arms 20 extending from the center portion 18 in a downstream direction and an upstream direction, respectively. An end member 22 is provided at the outer free end of each of the arms 20. Each end member 22 has an outer rectangular block-like configuration. The member 22 is hollow and has a base 24 with a spring well 26 formed therein. The well 26 faces upwardly toward the hollow interior of the member 22. A side slot 28 is formed in the side of the member 22 adjacent to the corresponding arm 20. The slot 28 extends from and through the bottom of the member 22 upwardly to a shoulder proximate to but spaced from the upper end of the sidewall.

The outer edge guide itself, i.e. the portion of the assembly that defines an outer side edge portion of the path P, is provided by a pair of ramp sections 30 retractably carried by the housing end members 22. The ramp sections 30 are biased into a position in which they extend along and define an outer side edge portion of the path P opposite the inner side edge portion defined by the inner edge guide 12. Each ramp section 30 has an upper portion that is biased to extend upwardly through a top opening in the respective end member 22. The top portion includes a ramp surface 32 that extends from the top of the ramp section 30 and slopes downwardly and laterally outwardly, with respect to the guide plates 8, 10. The inner side of the ramp section 30 facing the path P forms a vertical abutment surface 34 that, during a print operation, abuts the outer edge of the media to cooperate with the inner edge guide 12 to laterally position the media. A tab or lip 36 extends horizontally from the bottom edge of the abutment surface 34 and into the side slot 28 in the end member 22. Engagement of the lip 36 in the slot 28 limits upward movement of the ramp section 30 relative to the end member 22. A downwardly-facing cavity 38 is formed in the lower portion of the ramp section 30 to form a spring well. A coil compression spring 40 has opposite ends receives in the well 38 and the well 26 in the end member base 24. The spring 40 biases the ramp section 30 into its extended use position shown in FIGS. 1, 3, and 5–7. In this position, the lip 36 abuts the shoulder formed by the upper end of the slot 28.

The outer edge guide housing 16 is slidably mounted on the lower guide plate 10 to permit an operator to slide the housing 16 toward and away from the inner edge guide 12 and thereby adjust the width of the guide path P to accommodate media having different widths. To accomplish the slidable mount, the center portion 18 of the housing 16 is provided with a small rectangular projection 42 projecting upwardly therefrom. An opening 44 extends vertically through the center portion 18 adjacent to but spaced laterally (relative to the path P) from the projection 42. In addition, the lower guide plate 10 has a pair of parallel, spaced apart and laterally extending slots 46 extending therethrough.

The edge guide housing 16 is slidably mounted on the lower surface of the guide plate 10 opposite the upper, guile path defining surface by means of a slide plate 50 secured to the lower surface of the guide plate 10. The slide plate 50 has an elongated laterally extending adjustment slot 52 extending vertically therethrough. In the assembled apparatus, the projection 42 on the center portion 18 of the housing 16 projects upwardly into the adjustment slot 52, and the opening 44 in the center portion 18 is aligned with the slot 52. An adjustment bolt 54 extends vertically through the opening 44 and the slot 52. The bolt 54 has a head 55 adjacent to the upper surface of the slide plate 50 and the lower surface of the guide plate 10. It extends from the head 55 through the slot 52 and opening 44 and projects downwardly from the opening 44. An adjustment knob 56 engages the projecting lower end of the bolt 54 to releasably secure the housing 16 relative to the slide plate 50. This, in turn, secures the ramp sections 30 in a lateral position relative to the inner edge guide 12.

The bolt 54 and knob 56 may take various forms. In the illustrated preferred embodiment, the bolt 54 is threaded, and the adjustment knob 56 threadedly engages the projecting outer end of the bolt 54. In order to adjust the position of the outer edge guide 30 to accommodate a change in media width, an operator need only loosen the knob 56, slide the housing 16 to the appropriate position, and then retighten the knob 56.

Figure 2:
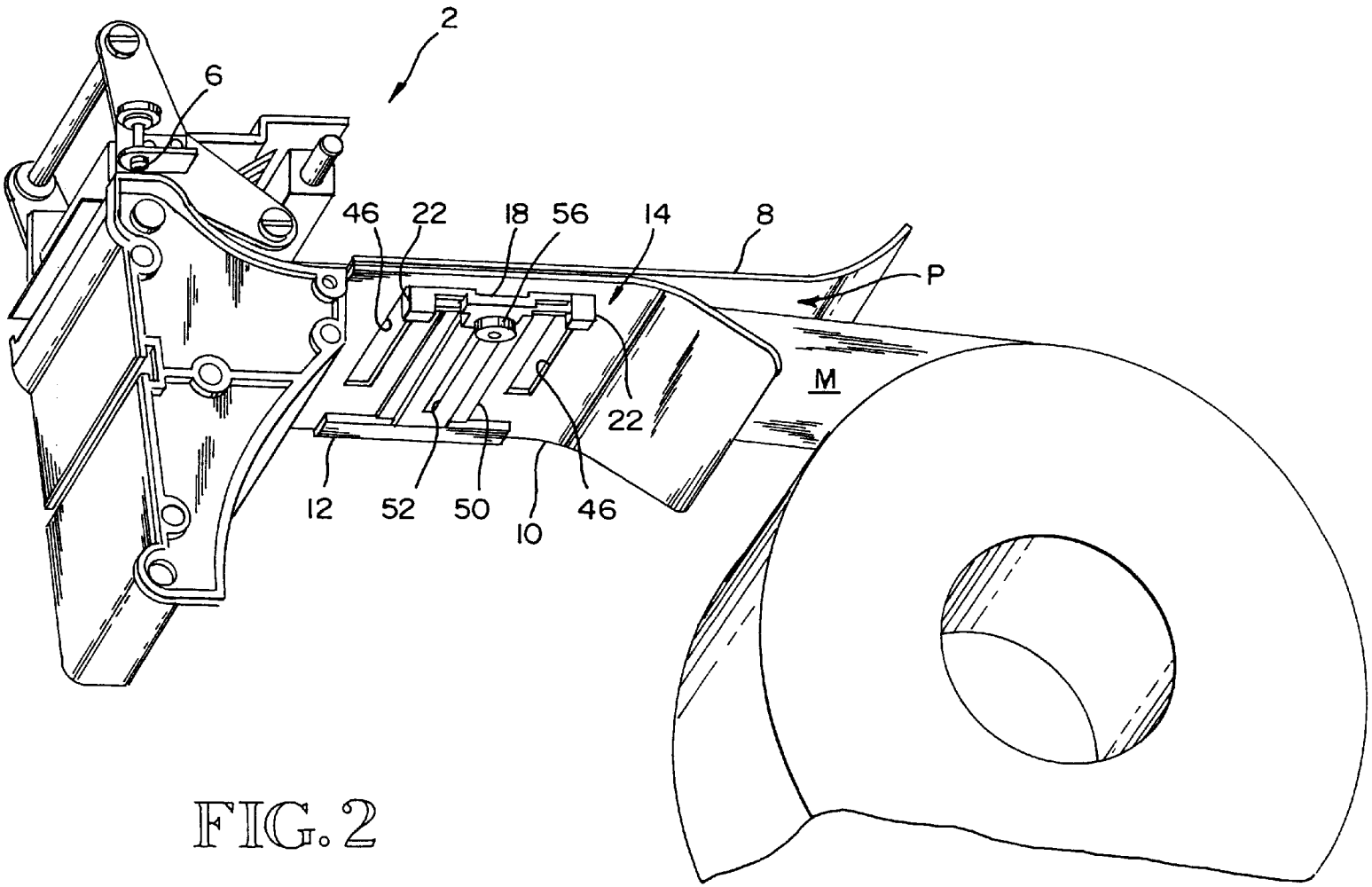
FIG. 2 is a pictorial view of the apparatus shown in FIG. 1 looking upwardly at the retractable and adjustable outer edge guide and with the upper guide plate included.
Figure 3:
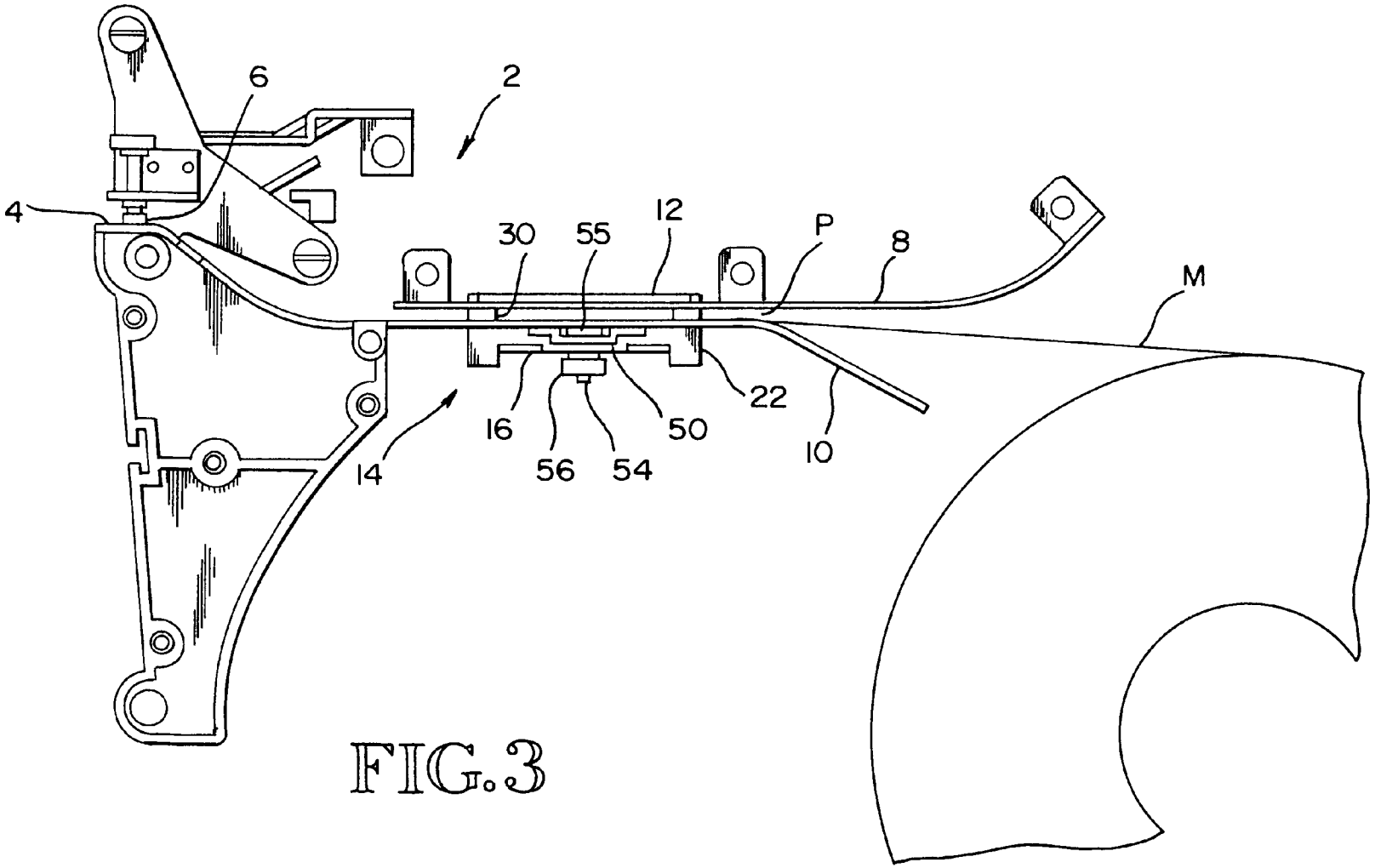
FIG. 3 is a side elevational view of the apparatus shown in FIG. 2.

The ramp sections 30 extend upwardly from their end member housing portions 22 through the parallel slots 44 in the lower guide plate 10. As the lateral position of the housing 16 is adjusted, the ramp sections 30 slide along their respective slots 46. FIGS. 2 and 4 illustrate the laterally outermost position of the ramp sections 30 corresponding to the widest media that can be accommodated by the guide apparatus. When the position of the ramp sections 30 is being adjusted, the engagement of the projection 42 in the slot 52 guides lateral movement of the housing 16 and helps prevent wobbling. The engagement of the projection 42 also helps maintain the ramp sections 30 in position after the adjustment is made. The hat-shaped cross section (FIG. 3) of the slide plate 50 further contributes to the stabilization of the housing 16.

In operation of the apparatus shown in FIGS. 1–7, prior to loading a new media roll, an operator lifts the cover of the printer 2 to gain access to the guide path P. After the cover is lifted, the print head 6 is raised away from the print station 4 to allow a portion of the media M to be placed in the print station 4. To load a new roll of media into the printer 2, the operator need only pull a short length of media M from the media roll, place the media roll in the media roll station, and slide the dispensed end of the roll into the media guide path P through the outer side thereof. As the media M passes over the ramp sections 30 and contacts the ramp surfaces 32, the ramp sections 30 automatically retract into their end members 22 against the biasing force of the springs 40. When the media M has been moved all the way into the path P, the springs 40 automatically return the ramp sections 30 into their upwardly projecting use positions.

When the new media roll is the same width as the previous media roll, the steps described above complete the loading operation. There is no need for any adjustment of the position of the outer edge guide 30. If the new media roll is of a different width than the previous roll, the position of the outer edge guide 30 must be adjusted prior to and/or after sliding the media M into the guide path P. For a new media width that is wider than the previous width, the adjustment preferably is accomplished in two steps before and after the movement of the media M into the path P. When the new media width is narrower, the adjustment may be accomplished in a single step performed after the media M has been moved into the path P.

Figure 8:
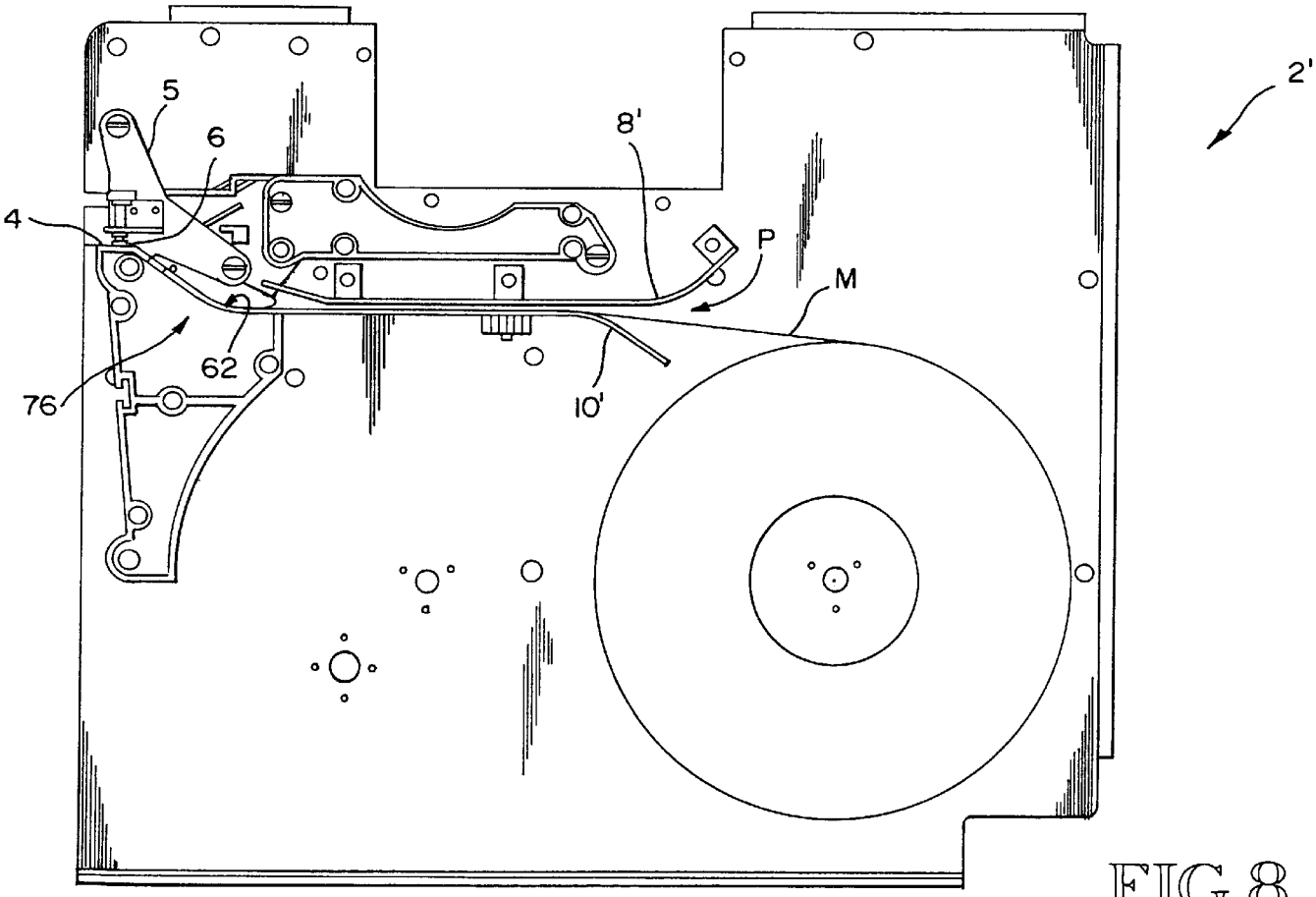
FIG. 8 is a side elevational view of a printer incorporating the second preferred embodiment of the invention, with portions of the printer housing omitted to facilitate illustration.

The second preferred embodiment of the guide apparatus is shown in FIGS. 8–17. As shown, the guide apparatus is incorporated into a printer 2' having a print station 4 and a print head 6 mounted on a print head assembly 5. The printer 2' is provided with an upper guide plate 8' and a lower guide plate 10'. The lower guide plate 10' has the same configuration as the lower guide plate 10 shown in FIGS. 1–4. The configuration of the upper guide plate 8' is substantially the same as that of the upper guide plate 8 shown in FIGS. 2–4. The main difference is that the downstream end of the upper guide plate 8' shown in FIGS. 8–12 is angled upwardly in a downstream direction. The angled downstream end accommodates the tracking wheel assembly 76 described below, as shown in FIG. 8.

Figure 9:
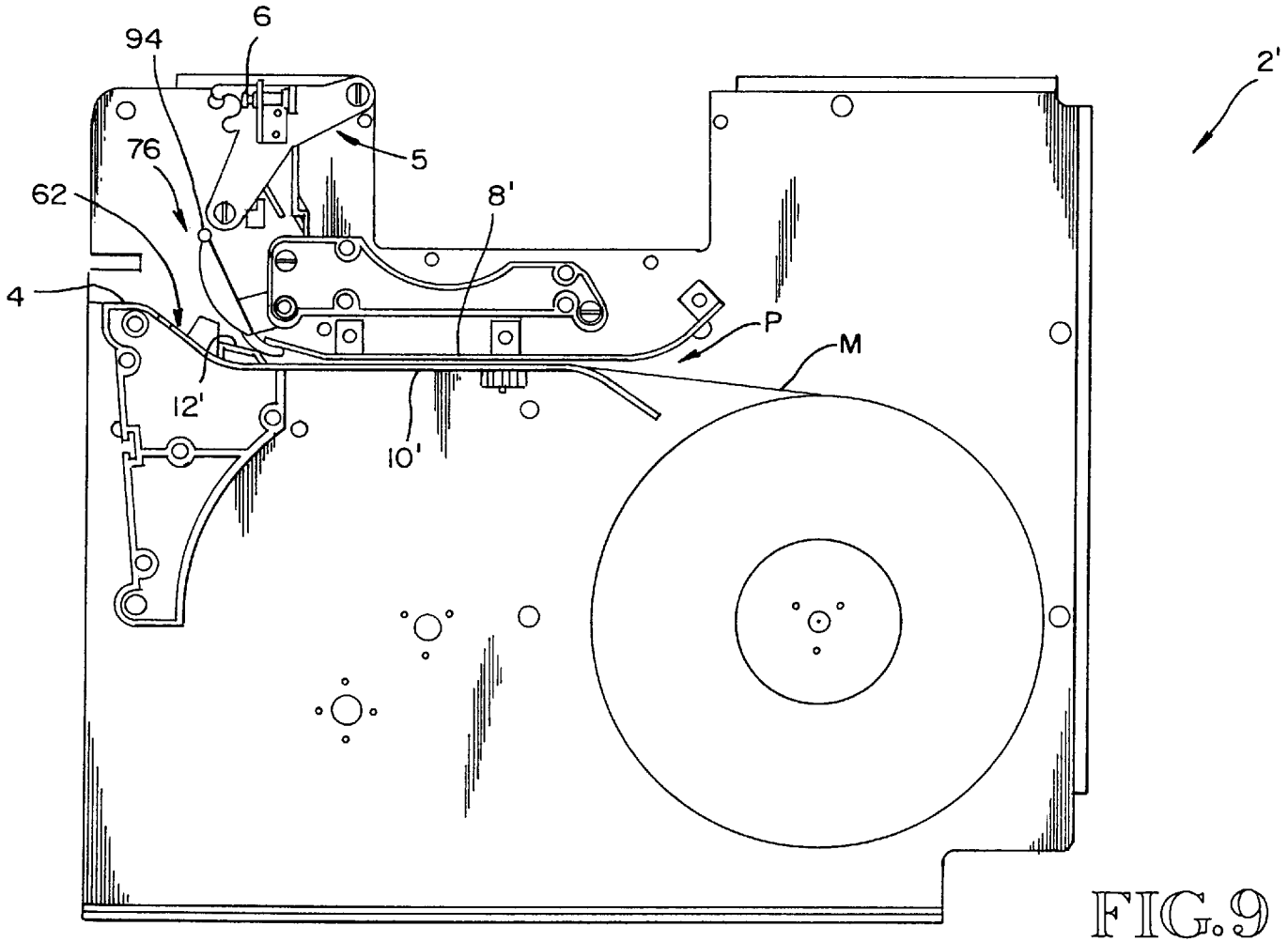
FIG. 9 is like FIG. 8 except that it shows the tracking wheel assembly in a retracted position.
Figure 10:
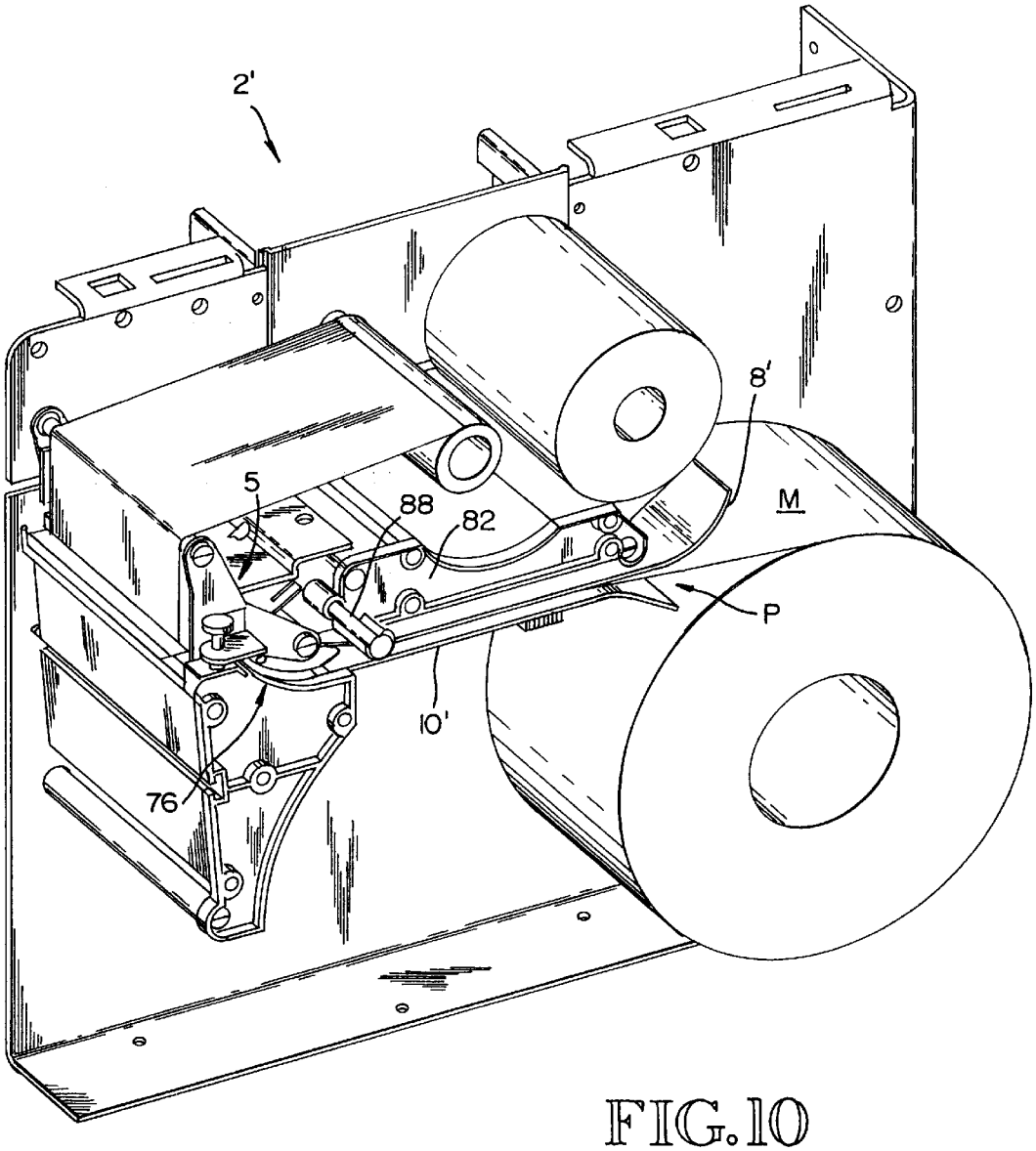
FIG. 10 is a pictorial view of the printer shown in FIGS. 8 and 9, with the print head assembly in its print position.
Figure 11:
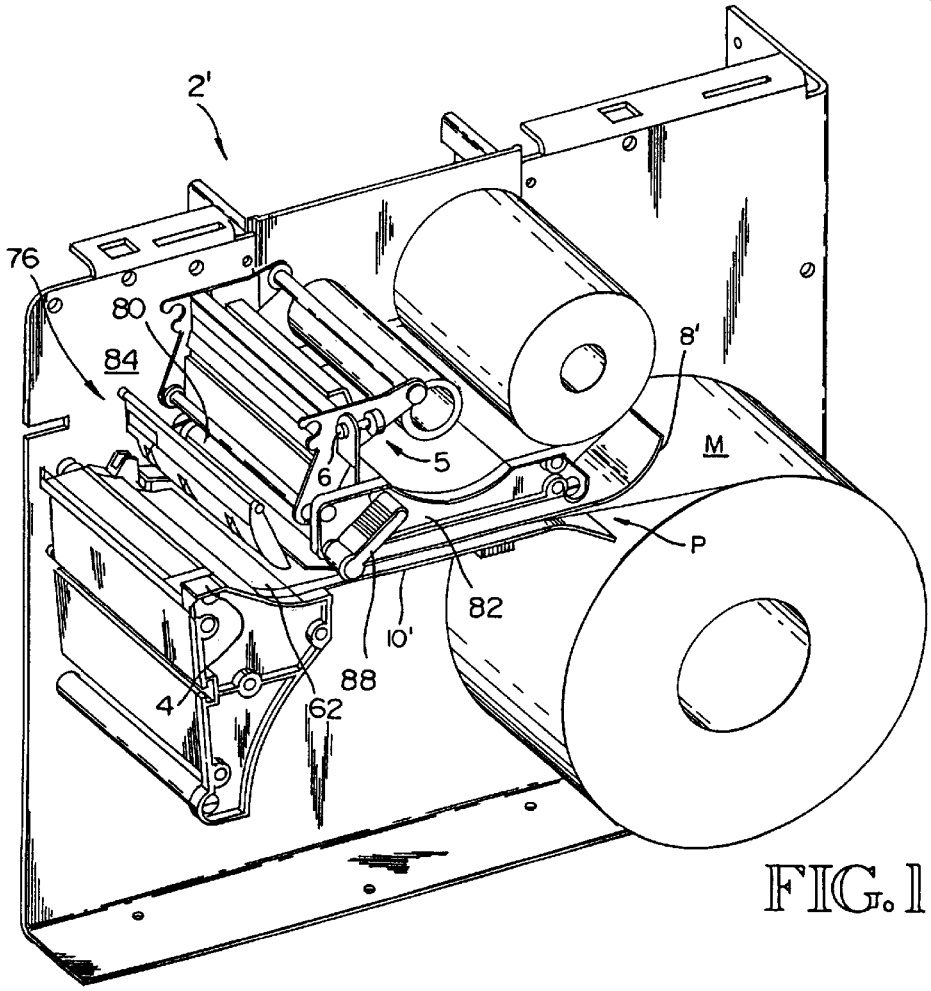
FIG. 11 is like FIG. 10 but with the print head assembly in a retracted position.
Figure 12:
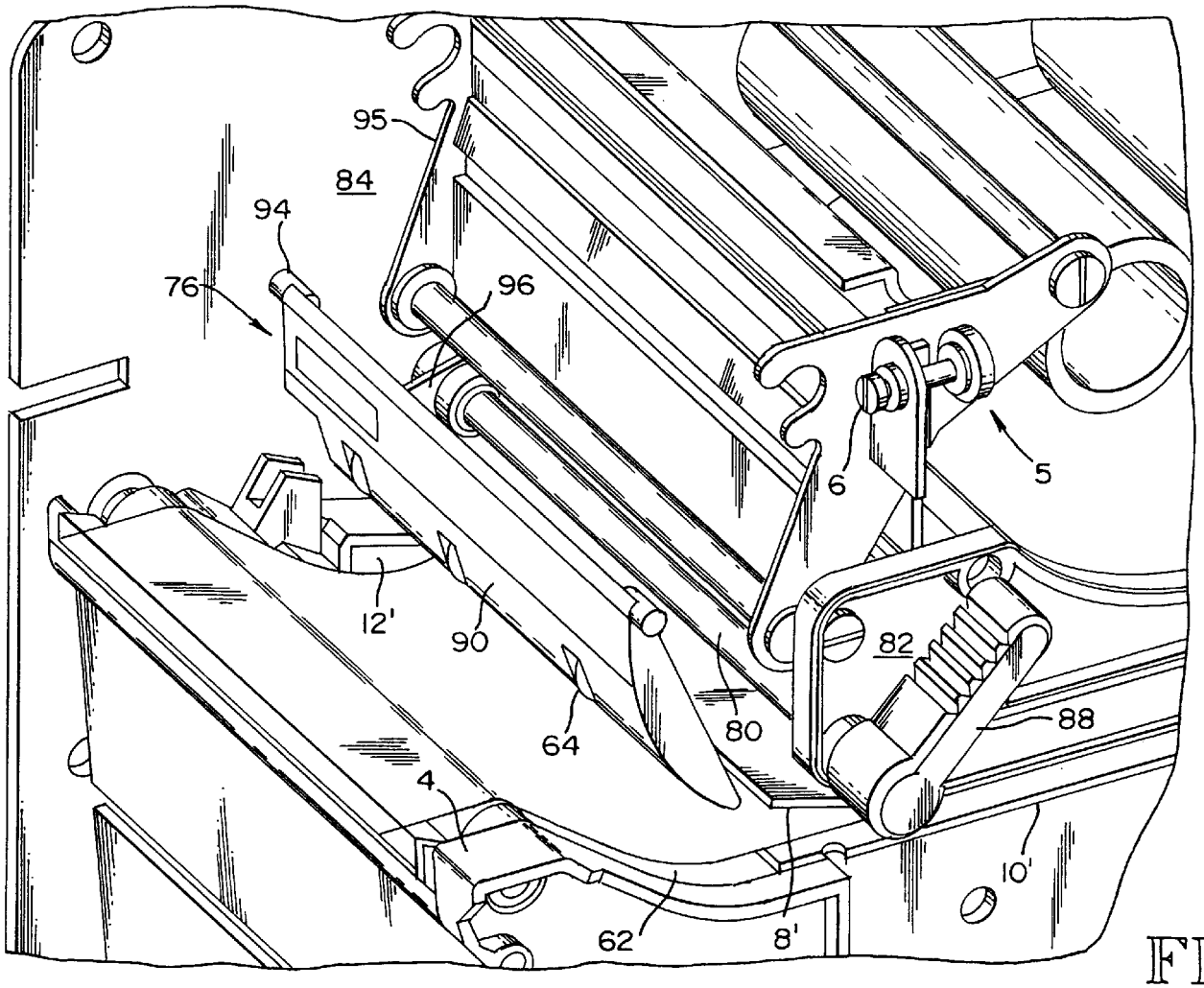
FIG. 12 is an enlarged pictorial view of a portion of the apparatus shown in FIG. 11.

Like the first embodiment shown in FIGS. 1–7, the second embodiment shown in FIGS. 8–17 includes means for allowing side loading of media M into the guide path P through an outer side thereof without requiring manual retraction of an edge guide, and for providing proper lateral tracking of the media M through the print station 4. In the second embodiment, this means includes an open outer side of the path P and means for applying to media M moving along the path P downstream toward the print station 4 a lateral force tending to move the media M against an inner edge guide. The inner edge guide 12' is located adjacent to the downstream end of the upper guide plate 8', as shown in FIGS. 9 and 12. The outer side of the path P is maintained in an open condition by omitting outer edge guides from the entire length of the guide path P. The laterally inward force on the media M is exerted by a tracking member that confronts a guide surface 62 formed by the upper surface of the lower guide plate 10'. The tracking member is biased to be urged against the upper face of media M moving along the path P toward the print station 4. The inner edge guide 12' extends along and defines an inner side edge portion of the path P substantially perpendicular to the guide surface 62.

Figure 17A:
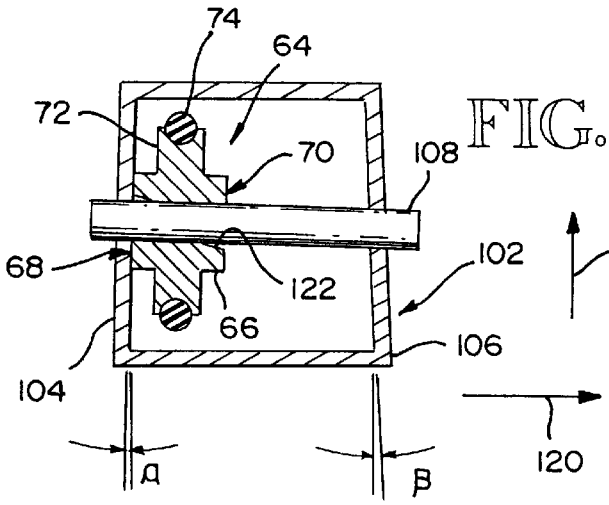
FIG. 17A is a partially schematic sectional view of one of the tracking wheels of the tracking assembly shown in FIGS. 8–16, with the wheel in its print position and the wheel shaft shown in plan.
Figure 17B:
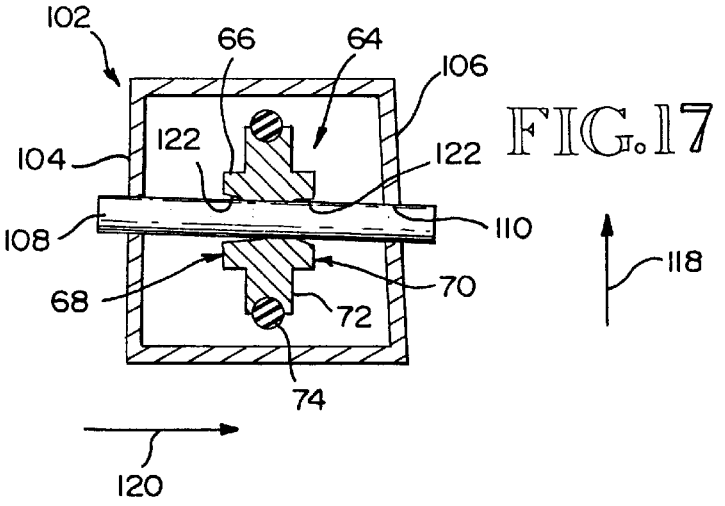
FIGS. 17B and 17C are similar to FIG. 17A except that they show the tracking wheel in a neutral position and a reload position, respectively.
Figure 17C:
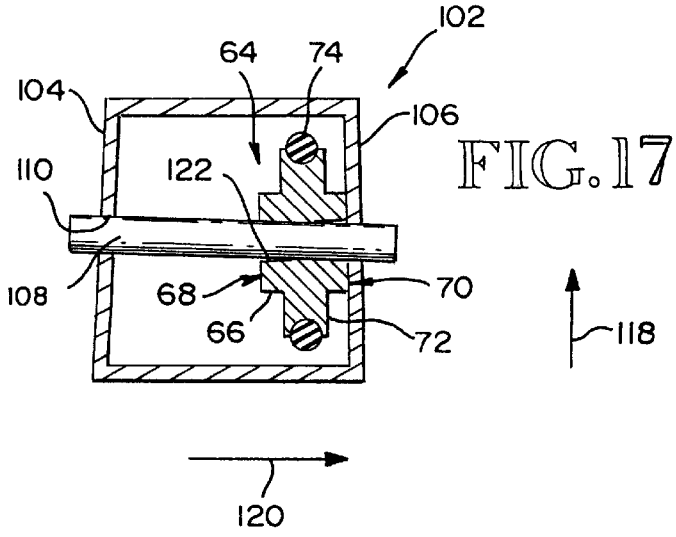

The tracking member preferably takes the form of a tracking wheel 64. The wheel 64 confronts the guide surface 62 and urges the media M against the guide surface 62. The wheel 64 is oriented generally in an upstream/downstream direction and is canted or angled slightly from its upstream/downstream orientation to provide the desired laterally inward force on the media M. The structure of the wheel is best seen in FIGS. 17A, 17B, and 17C. The wheel has an enlarged diameter hub 66 with an axial opening extending therethrough to receive a wheel shaft 108. The opposite radial surfaces of the hub 66 form an outer abutment surface 68 and an inner abutment surface 70, respectively. A reduced diameter rim 72 extends around the outer circumference of the hub 66 and projects radially therefrom. A high friction rubber tire 74 is provided around the outer circumferential edge of the rim 72. The tire 74 is positioned to be urged against the upper face of media M moving along the path P to provide good frictional contact between the tracking wheel 64 and the media M.

Although guide apparatus with a single tracking wheel is within the scope of the invention, the guide apparatus preferably includes a plurality of guide wheels 64, each of which has the structure illustrated in FIGS. 17A, 17B, and 17C and described above. In the preferred embodiment, there are three tracking wheels 64. The wheels are laterally spaced apart to position them optimally for media of different widths requiring different amounts of laterally inward tracking force. The laterally inwardmost wheel 64 is positioned to engage relatively narrow media. Media of intermediate width are engaged by the laterally innermost and the middle tracking wheels 64. Media of relatively wide width are engaged by all three tracking wheels 64. Thus, a greater degree of tracking force is provided for intermediate and wide media to provide proper lateral tracking of the media and prevent lateral wandering thereof.

The three tracking wheels 64 are provided as part of a tracking wheel assembly 76. The assembly 76 includes a tracking wheel housing 78, 78' in which the tracking wheels 64 are mounted. The assembly 76 is pivotally mounted on mounting portions 82, 84 of the printer 2' by a pivot shaft 80. As shown in FIGS. 11 and 12, the mounting portions 82, 84 include a mounting plate 82, and a back plate 84. The assembly 76 is pivotal about the pivot shaft axis X between a use position in which the tracking wheels 64 are urged against the upper face of the media M and a retracted position in which the tracking wheels 64 are retracted away from the face. FIGS. 8 and 10 illustrate the use position, and FIGS. 9, 11, and 12 illustrate the retracted position.

The housing 78 has a media guide surface 90, which confronts the face of the media M in the use position of the assembly 76, and a removable back cover 92. This structure is best seen in FIGS. 13–16. The housing 78, 78' also has a contact surface formed by two contact lugs 94. The lugs 94 project laterally from the opposite sides of the downstream edge of the assembly 76. The contact surface 94 is positioned to be contacted by a portion 95 of the print head assembly 5. As is typical in known printers, the print head assembly 5 has a print position and a retracted position. In the illustrated printer 2', the print position is shown in FIGS. 8 and 10, and the retracted position is shown in FIGS. 9, 11, and 12. In the print position, the contact portion 95 of the assembly 5 contacts the contact surface 94 of the tracking wheel assembly 76 to hold the assembly 76 in its use position. The assembly 5 is pivotable between its print and retracted positions by operating a lever 88, shown in FIGS. 10–12. The lever 88 is secured to one end of the pivot shaft 80 and is keyed to a flat 81 to prevent relative rotation. The opposite end of the shaft 80 nonrotatably engages the assembly 5.

To mount the assembly 76 and bias it into its retracted position, the assembly 76 is provided with a mounting lug 96 that projects upwardly from the laterally inward upstream edge of the housing 78, 78'. A bearing 98 is carried by the lug 96 to pivotally mount the assembly 76 on the pivot shaft 80. The pivot shaft 80 is received through a central axial opening in the bearing 98. A torsion retract spring 100 is mounted on the lug 96 to engage the assembly 76 and bias it toward its retracted position.

Figure 13:
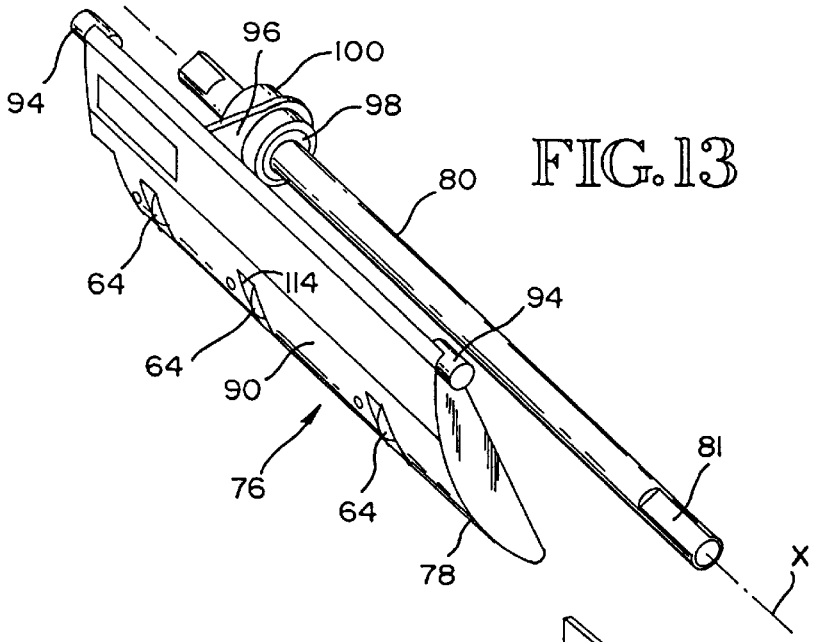
FIG. 13 is a pictorial view of the tracking wheel assembly and pivot shaft shown in FIGS. 8–12.
Figure 15:
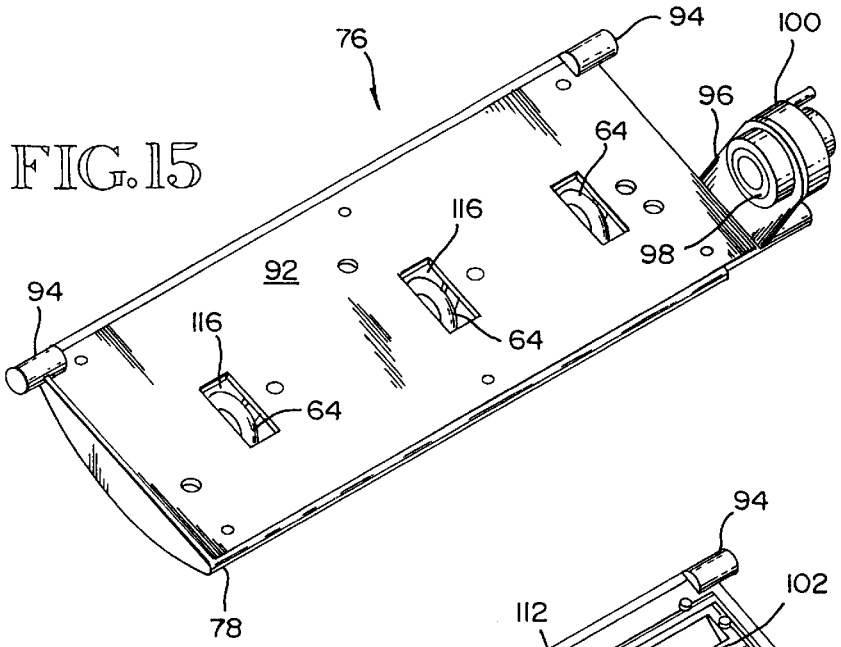
FIG. 15 is a pictorial view similar to FIG. 14 but looking toward the opposite face of the assembly.
Figure 16A:
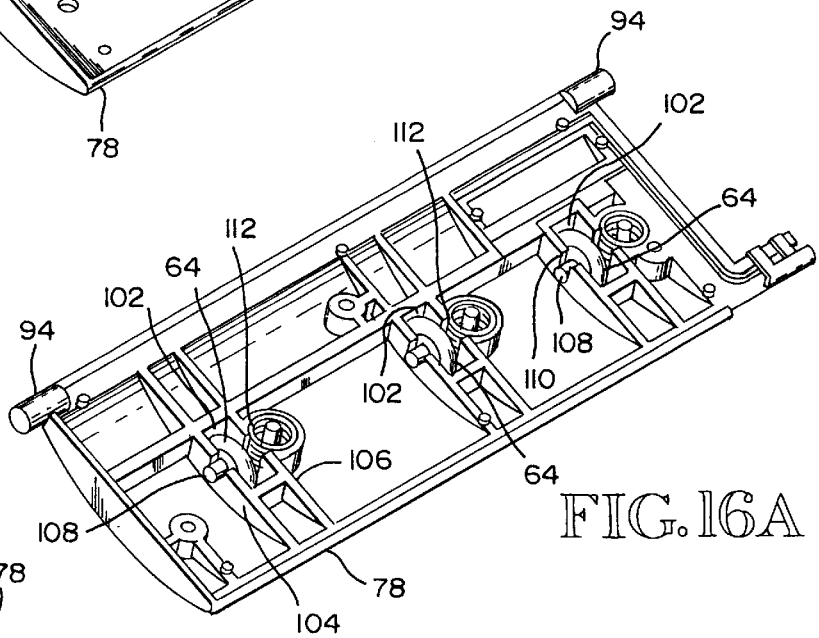
FIG. 16A is a pictorial view similar to FIG. 15 but with the cover plate of the assembly removed to reveal the inner structure.
Figure 14:
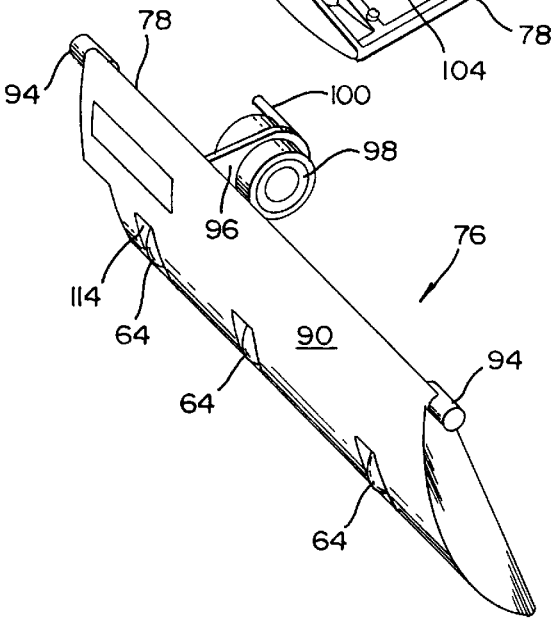
FIG. 14 is an enlarged pictorial view of the tracking wheel assembly looking toward the media engaging face and one side thereof.

The mounting of the tracking wheels 64 in the housing 78, 78' is illustrated in FIGS. 15–17. Referring to FIGS. 15, 16A, and 17A–17C, in a first form of the assembly 76, the housing 78 has a wheel well 102 for each of the wheels 64. The three wheel wells 102 are laterally spaced apart, as shown in FIGS. 13–16, to provide the desired lateral spacing of the wheels 64. Each well 102 has a laterally outer wall 104 and an opposite laterally inner wall 106, as shown in FIGS. 16A and 17. For each wheel 64, a wheel shaft 108 extends laterally across the respective wheel well 102 to rotatably mount the wheel 64 therein. The ends of the shaft 108 are received in slots 110 in the walls 104, 106. One end of the shaft 108 extends into a spring well and is engaged by a coil compression spring 112. The spring 112 engages the shaft 108 to bias the wheel 64 mounted thereon downwardly toward the guide surface 62. An opening 114 in the media guide surface 90 is provided for each wheel 64 to allow the wheel 64 to project from the housing 78 and engage the upper face of the media M to urge the media M against the guide surface 62. The openings 114 are shown in FIGS. 13 and 14. Preferably, the back cover 92 of the housing 78 also has an opening 116 for each wheel 64. The openings 116 help prevent binding of the wheels 64 against the back cover 92, as illustrated in FIG. 15. Each wheel 64 is freely rotatable about its shaft 108.

FIGS. 16B and 16C show a modified form of the tracking wheel assembly. A major difference between the modified assembly and the assembly 76 shown in FIG. 16A is the form of the biasing spring that biases the wheels 64 toward the guide surface 62. The housing 78', and particularly the wheel wells 102' and inner walls 106' thereof, are modified to accommodate the different spring structure. The spring well that receives the coil spring 112 of the assembly housing 78 shown in FIG. 16A is omitted in the housing 78' shown in FIGS. 16B and 16C since it is not needed. Aside from these differences, the two assembly housings are essentially identical.

Referring to FIGS. 16B and 16C, the biasing spring 130 is a leaf spring having a flat elongated main portion 132. A plurality of fingers 134 extend laterally from the main portion 132. The fingers 134 are arranged in three parallel pairs, one for each wheel 64. Each pair of fingers 134 straddles the wheel well 102' for its respective wheel 64 with the two fingers 134 in the pair engaging the opposite ends of the wheel shaft 108 to urge the shaft 108, and thereby the wheel 64, toward the guide surface 62. The fingers 134 have the bent configuration best seen in FIG. 16B. The positioning of the spring 130 in the housing 78', as shown in FIG. 16C, and the closing of the housing 78' by attaching the back cover 92 thereto holds the spring 130 in its biasing position in which the fingers 134 are resiliently urged against the wheel shafts 108.

The modified form of spring biasing illustrated in FIGS. 16B and 16C is currently preferred since it provides a simple structure with a minimum number of parts. It is also easy to assemble and provides an even biasing force on both ends of each wheel shaft 108. The functioning of the modified assembly shown in FIGS. 16B and 16C is essentially the same as that of the assembly shown in FIG. 16A and described below.

The desired canting of each wheel 64 is provided by the orientation of the wheel shaft 108 and the structure of the wheel well 102. This is illustrated in FIGS. 17A, 17B, and 17C. The downstream direction is indicated by arrows 118 in these figures. The laterally inward direction is indicated by arrows 120. The wheel shaft 108 is canted in an upstream direction from the laterally outer wall 104 of the well 102 to the opposite laterally inner wall 106. The outer wall 104 is inclined laterally inwardly in a downstream direction. The inclination of the wall 104 and the canting of the shaft 108 cause the wheel 64 to be automatically moved against the wall 104 and into a canted position by movement of media M downstream past the wheel 64 toward the print station 4. Movement of the media M and the frictional engagement of the tire 74 with the media M move the wheel 64 along the shaft into the laterally outer position shown in FIG. 17A. Tapered portions 122 of the inner circumferential surface of the wheel hub 66 defining the axial opening therethrough provide enlarged edges of the opening to permit tilting of the wheel 64 on the shaft 108. As shown in FIG. 17A, the outer radial abutment surface 68 of the wheel hub 66 abuts the outer wall 104, and the wheel 64 is canted laterally inwardly in a downstream direction from its general upstream/downstream orientation. This causes the wheel 64 to exert on media M moving downstream past the wheel 64 a laterally inward force, indicated by arrow 120, toward the inner edge guide 12'. The laterally inward force prevents lateral wandering of the media M.

The illustrated preferred embodiment is designed to accommodate both batch printing and demand printing. These two types of printing are described above. In order to prevent the wheel 64 from exerting a laterally outward force on the media as the media is moved back upstream following a demand print operation, the preferred embodiment includes a wheel mounting that allows the cant of the wheel to be neutralized and preferably reversed for upstream movement of the media M. The wheel well 102 has a width sufficient to allow the wheel 64 to slide laterally along the wheel shaft 108. The laterally inner wall 106 is at least parallel to the direction of travel of the media M along the path P, to prevent the wheel 64 from exerting the undesirable laterally outward force. If the inner wall 106 is parallel, its effect regarding lateral tracking is neutralized during upstream movement. It exerts neither a laterally outward nor a laterally inward force. The parallel orientation of the wheel 64 is illustrated in FIG. 17D.

In the currently preferred embodiment, the inner wall 106 is inclined laterally outwardly in a downstream direction to cause the wheel 64 to exert a laterally inward force on media M moving upstream along the path P. As illustrated in FIG. 17C, upstream movement of the media M automatically slides the wheel 64 laterally inwardly along the shaft 108 and against the inner wall 106. The laterally inward abutment surface 70 of the wheel hub 66 abuts the wall 106 to cause the wheel to cant laterally outwardly from its parallel position. This causes the desired laterally inward force on the media M to provide positive lateral tracking for media moving in the upstream direction as well as media moving in the downstream direction.

The degree of inclination of the well walls 104, 106 may be varied without departing from the spirit and scope of the invention. In FIG. 17A, the angle $\alpha$ indicates the angle of inclination of the outer wall 104. The angle $\beta$ indicates the angle of inclination of the inner wall. One example of suitable angles are an angle $\alpha$ of 2° and an angle $\beta$ of 1°. The angle $\alpha$ is preferably chosen so that the outer wall 104 is perpendicular to the shaft 108.

In the operation of the embodiment illustrated in FIGS. 8–17, all that is required to load a new roll of media M is to lift the printer cover and operate the print head assembly lever 88 to raise the print head assembly 5 and then slide a length of the media M into the guide path P through its open outer side. The raising of the assembly 5 allows the spring 100 to automatically retract the tracking wheel assembly 76. Since lifting the cover and raising the print head assembly 5 are necessary regardless of the presence or absence of edge guide apparatus or the nature of any such apparatus that is provided, the present invention thus makes it possible to side load the media with the only added step being the simple step of sliding the media into the path. In addition, this is all that is required regardless of the width of the medial being loaded and its relationship to the width of previously used media. There is no need to ever adjust any guide apparatus for differing media widths since, when the printer is operated, the tracking wheels 64 automatically move media M of any width up against the inner edge guide 12' to automatically adjust for a change in media width. The result is automatic, accurate lateral tracking independent of the skill of the operator. When a new roll of media has been loaded, the lever 88 is operated to return the print head assembly 5 to its print position. As the assembly 5 moves toward its print position, its surface 95 engages the contact surface 94 of the tracking wheel assembly 76 to automatically move the assembly 76 into its use position. The printing operation may then be started.

Although the preferred embodiments of the invention have been illustrated and described herein, it is intended to be understood by those skilled in the art that various modifications and omissions in form and detail may be made without departing from the spirit and scope of the invention as defined by the following claims.

What is claimed is:

1. In a printer of a type having a print station and a guide path extending from a media roll station to the print station, guide apparatus comprising:

an inner edge guide extending along and defining an inner side edge portion of the path; and means for allowing side loading of media into the guide path through an outer side thereof opposite said side edge portion without requiring manual retraction of a structural element defining a side portion of the guide path, and for providing proper lateral tracking of the media through the print station;

wherein said means for allowing side loading and for providing lateral tracking comprises a retractable outer edge guide biased into a position extending along and defining an outer side edge portion of the path opposite said inner side edge portion, said outer edge guide being automatically retractable in response to media being passed thereover and moved into the guide path through said outer side.

2. The apparatus of claim 1, wherein said outer edge guide is movable toward and away from said inner edge guide, to permit adjustment of the width of the guide path to accommodate media having different widths.

3. The apparatus of claim 2, comprising a guide plate extending along the guide path, said outer edge guide being slidably mounted on said plate to permit an operator to slide said outer edge guide toward and away from said inner edge guide and thereby adjust the width of the guide path to accommodate media having different widths.

4. The apparatus of claim 3, comprising an elongated outer edge guide housing slidably mounted on said plate and having opposite ends, said outer edge guide comprising a retractable ramp section at each of said opposite ends, each said ramp section having a ramp surface positioned to be contacted by media moving into the guide path through said outer side.

5. The apparatus of claim 1, wherein said outer edge guide includes a ramp surface positioned to be contacted by media moving into the guide path through said outer side.

6. In a printer of a type having a print station and a guide path extending from a media roll station to the print station, guide apparatus comprising:

an inner edge guide extending along and defining an inner side edge portion of the path; and a retractable outer edge guide positioned on an outer side of the path and biased into a position extending along and defining an outer side edge portion of the path opposite said inner side edge portion, said outer edge guide being automatically retractable in response to media being passed thereover and moved into the guide path through said outer side.

7. The apparatus of claim 6, wherein said outer edge guide is movable toward and away from said inner edge guide, to permit adjustment of the width of the guide path to accommodate media having different widths.

8. The apparatus of claim 6, comprising a guide plate extending along the guide path, said outer edge guide being slidably mounted on said plate to permit an operator to slide said outer edge guide toward and away from said inner edge guide and thereby adjust the width of the guide path to accommodate media having different widths.

9. The apparatus of claim 8, comprising an elongated outer edge guide housing slidably mounted on said plate and having opposite ends, said outer edge guide comprising a retractable ramp section at each of said opposite ends, each said ramp section having a ramp surface positioned to be contacted by media moving into the guide path through said outer side.

10. The apparatus of claim 9, comprising a slide plate secured to a surface of said guide plate opposite the guide path and having an elongated laterally extending adjustment slot extending therethrough; wherein said guide plate has a pair of spaced apart laterally extending slots extending therethrough, said ramp sections projecting through said pair of slots, and the apparatus includes an adjustment bolt projecting through said adjustment slot and an opening in said outer edge guide housing, and an adjustment knob engaging said bolt to releasably secure said housing relative to said slide plate and said ramp sections in a lateral position relative to said inner edge guide.

11. The apparatus of claim 6, wherein said outer edge guide includes a ramp surface positioned to be contacted by media moving into the guide path through said outer side.

* * * * *

UNITED STATES PATENT AND TRADEMARK OFFICE

CERTIFICATE OF CORRECTION

PATENT NO. : 6,068,418
DATED : May 30, 2000
INVENTOR(S) : Duane M. Fox

It is certified that error appears in the above-identified patent and that said Letters Patent is hereby corrected as shown below:

Column 5,
Line 46, "receives" should be -- received --.
Line 64, "guile" should be -- guide --.

Claim 3, column 11,

Line 32, "claim 2" should be -- claim 1 --.

Signed and Sealed this

Eighteenth Day of September, 2001

*Attest:*

Nicholas P. Godici

NICHOLAS P. GODICI
*Acting Director of the United States Patent and Trademark Office*

*Attesting Officer*